US006494383B2

(12) United States Patent
Augustin

(10) Patent No.: US 6,494,383 B2
(45) Date of Patent: Dec. 17, 2002

(54) CONTROL VALVE CONFIGURATION FOR USE IN A FUEL INJECTOR FOR INTERNAL COMBUSTION ENGINES

(75) Inventor: Ulrich Augustin, Kernen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/073,553

(22) Filed: Feb. 11, 2002

(65) Prior Publication Data

US 2002/0109014 A1 Aug. 15, 2002

Related U.S. Application Data

(63) Continuation of application No. PCT/DE00/02642, filed on Aug. 8, 2000.

(30) Foreign Application Priority Data

Aug. 10, 1999 (DE) ..... 199 37 713

(51) Int. Cl.[7] ..... B05B 9/00

(52) U.S. Cl. ..... 239/124; 239/88; 239/90; 239/92; 239/96; 239/584; 239/585.1; 239/585.2; 239/586

(58) Field of Search ..... 239/88, 90, 91, 239/92, 93, 94, 96, 124, 583, 584, 585.1, 585.2, 586

(56) References Cited

U.S. PATENT DOCUMENTS 5,241,935 A 9/1993 Beck et al.
5,407,131 A 4/1995 Maley et al.
5,460,329 A 10/1995 Sturman
5,788,154 A * 8/1998 Beatty ..... 239/124
5,915,623 A * 6/1999 Knight et al. ..... 239/88
6,161,774 A * 12/2000 Ricco ..... 239/585.1
6,371,382 B1 * 4/2002 Niethammer et al. .... 239/585.1
6,412,706 B1 * 7/2002 Guerrassi et al. ..... 239/96

FOREIGN PATENT DOCUMENTS

DE 35 29 576 A1 2/1987
DE 197 01 879 A1 7/1998
EP 0 826 877 A2 3/1998
EP 0 995 903 A2 4/2000
JP 59 168 258 A 9/1984

* cited by examiner

*Primary Examiner*—Robin O. Evans
(74) *Attorney, Agent, or Firm*—Laurence A. Greenberg; Werner H. Stemer; Ralph E. Locher

(57) ABSTRACT

A control valve configuration is described which is used in a fuel injector for internal combustion engine. The control valve contains a valve body that can be displaced axially in a valve chamber by an actuating device and is formed of two rigidly connected sections. A first section of the valve body forms a seat valve between the valve inlet and valve outlet in a first section of the valve chamber. The seat valve is closed in a rest position of the valve body and is opened in a working position of the valve body. A second section of the valve body and a second section of the valve chamber form a slide valve which, in the rest position of the valve body, produces a fluidic connection between the valve outlet and a return opening and blocks the fluidic connection between the seat valve and the valve outlets and which closes the return opening and then starts to produce a fluidic connection between the seat valve and the valve outlet only after it leaves the rest position.

17 Claims, 6 Drawing Sheets

CONTROL VALVE CONFIGURATION FOR USE IN A FUEL INJECTOR FOR INTERNAL COMBUSTION ENGINES

CROSS-REFERENCE TO RELATED APPLICATION

This application is a continuation of copending International Application PCT/DE00/02642, filed Aug. 8, 2000, which designated the United States.

BACKGROUND OF THE INVENTION

FIELD OF THE INVENTION

The invention relates to a control valve configuration for use in a fuel injector for an internal combustion engine. Configurations of this generic type are disclosed, for example, in U.S. Pat. Nos. 5,460,329 and 5,407,131.

In the case of the control valve configuration according to U.S. Pat. No. 5,460,329, fuel passes as a control fluid through an electromagnetically actuable control valve, which is configured as a slide valve, to a pressure intensifier in the injector. Via the electromagnetic activation, at defined times or crank angles of the internal combustion engine the fuel to be injected is placed under high pressure by the pressure intensifier. The fuel which is placed under high pressure then causes, in the conventional manner, the valve needle on the nozzle of the injector to lift off from its seat and to open up the path for the fuel to the nozzle opening, in order to inject the fuel into the combustion chamber of the engine.

Another type of control valve for a fuel injector that operates with a cam-operated pressure-intensifying piston, is described in U.S. Pat. No. 5,407,131. The control valve here is a seat valve that is normally, i.e. in the rest state, open and which can be closed with the aid of a solenoid. In the open state, the fuel delivered from the tank by a lowpressure fuel pump flows back through the control valve to the tank. The fuel injection into the combustion chamber of a diesel engine is initiated by energizing the solenoid, the magnetic force of which brings the seat valve into the closed operating state. The fuel in the injector, which is now no longer able to flow away, is placed under pressure as a consequence of the cam-actuated piston of the pressure intensifier. When the pressure has reached the defined nozzle-needle opening pressure, the injection starts. The injection is ended by deenergizing the solenoid, whereupon the seat valve is re-opened, so that the fuel can flow away again and the pressure in the injector falls.

Leakage and losses which arise due to leaking and as a consequence of the seepage form a problem which generally occurs in the case of control valve configurations for fuel injection and in particular also in the case of the known configurations dealt with above. The sealing function is restricted both in the case of the slide valves and in the case of the seat valves. Slide valves are only inadequately sealed over the sealing gap, and in the case of seat valves, the sealing function is undertaken only in one direction by the seat. Also, relatively long-lasting seepages, for example by keeping open a valve for the control fluid during the rest state, as in the case of the configuration according to U.S. Pat. No. 5,407,131 mentioned above, are to be evaluated as a loss.

SUMMARY OF THE INVENTION

It is accordingly an object of the invention to provide a control valve configuration for use in a fuel injector for internal combustion engines which overcomes the above-mentioned disadvantages of the prior art devices of this general type, in which losses occurring during use are reduced.

With the foregoing and other objects in view there is provided, in accordance with the invention, a control valve configuration for use in a fuel injector for an internal combustion engine. The control valve configuration contains a housing having a valve chamber, a valve inlet for a fluid which is under pressure, and a valve outlet for hydraulically controlling an injection process at a nozzle of the fuel injector. The valve chamber has a first section, a second section, and a return opening. The housing further has a chamber wall defining a rear of the valve chamber and a seat defining a first part of a seat valve disposed in the first section. An actuating device is disposed in the housing. A valve body is disposed in the valve chamber, and the valve body can be displaced axially by the actuating device. Depending on a position of the valve body, the valve body produces or blocks a fluidic connection between the valve inlet and the valve outlet. The valve body has a first valve section forming a second part of the seat valve disposed between the valve inlet and the valve outlet in the first section of the valve chamber. The seat valve is closed in a rest position of the valve body and is opened in a working position of the valve body. The valve body has a second valve section rigidly connected to the first valve section. The second section of the valve chamber and the second valve section form a slide valve which, in the rest position of the valve body produces a fluidic connection between the valve outlet and the return opening and blocks a fluidic connection between the seat valve and the valve outlet. The slide valve closes the return opening and then starts to produce a fluidic connection between the seat valve and the valve outlet only after the valve body leaves the rest position. The first section of the valve chamber leads through the seat of the seat valve in a direction of flow into the second section of the valve chamber.

Accordingly, the valve body that can be displaced axially in the valve chamber by the actuating device has two rigidly connected sections. A first section of the valve body forms a seat valve between the valve inlet and valve outlet in a first section of the valve chamber, the seat valve being closed in a rest position of the valve body and being opened in a working position of the valve body. A second section of the valve body and a second section of the valve chamber form a slide valve which, in the rest position of the valve body, produces a fluidic connection between the valve outlet and a return opening and blocks the fluidic connection between the seat valve and the valve outlet, and which closes the return opening and then starts to produce a fluidic connection between the seat valve and the valve outlet only after it leaves the rest position.

The control valve configuration according to the invention therefore forms two individual valves which are connected in series and one of which is configured as a seat valve and the other of which is configured as a slide valve. Since, in the rest position of the valve body, the outlet of the valve configuration is cut off from the inlet pressure by the closed seat valve and additionally by the slide valve and is connected to the return opening, the outlet is kept unpressurized in this phase without control fluid flowing as wastage through the configuration. In addition, the leakage losses in this phase remain low as a consequence of the cumulative sealing actions of the seat valve and slide valve (connected one behind the other). Since the seat valve naturally begins to open immediately the valve body leaves the rest position, the space between the valve and the slide valve can already be filled with the inlet pressure before the slide valve, after obstructing the return opening, opens up the path to the outlet, with the result that the pressurization of the outlet takes place abruptly.

The outlet of the control valve configuration according to the invention is therefore particularly well-suited for a hydraulic control of the injection process, in which the injection phase is initiated by transfer of the valve body into the working position and the injection interval is determined by the rest position of the valve body.

In the case of a preferred embodiment, the first section of the valve body is a control piston which slides in a tight-fitting manner in the first section of the valve chamber and on the front side of which, which faces the seat valve, an annular active surface which is exposed to the valve inlet pressure is formed. A control space behind a rear active surface of the control piston is connected to the valve inlet via a feed restrictor and to a return connection via a discharge restrictor that is to be opened by the actuating device. In this connection, flow resistances of the restrictors and a proportion in size between the annular active surface and the rear active surface are dimensioned in such a manner that the valve body moves into the working position when the discharge restrictor is opened and moves into the rest position when the discharge restrictor is closed.

In this embodiment, the control piston is preferably configured in such a manner that when it reaches its working position, it presses in a sealing manner onto an access from the control space to the discharge restrictor. This ensures, within the meaning of the above problem definition, that the seepage losses remain limited to the short transition phase of the control piston from the rest position into the working position.

In accordance with an added feature of the invention, the first section of the valve chamber that contains the control piston has a diameter larger than a diameter of the second section of the valve chamber that forms the slide valve. The seat of the seat valve is formed by a conically shaped housing edge of the housing that is situated at a transition region between the first and second sections of the valve chamber. The front side of the control piston has an annular surface with a central zone that rests in a sealing manner on the seat when the valve body is in the rest position.

In accordance with an additional feature of the invention, the annular surface on the front side of the control piston is a tapering transition area on the valve body connecting the first valve section to the second valve section. The first valve section has a diameter greater than a diameter of the second valve section. The housing has an annular groove with a constricted continuation. The conically shaped housing edge forming the seat of the seat valve is an edge of the housing disposed between the annular groove and the constricted continuation in the valve chamber. The valve inlet leads into the annular groove and the annular groove has a diameter larger than the diameter of the first section of the valve chamber. The constricted continuation of the annular groove forms a control edge for the slide valve at the transition region to the second section of the valve chamber.

In accordance with a further feature of the invention, the second valve section has a further annular groove. The further annular groove has an axial dimension dimensioned in such a manner that it spans a distance between the return opening and the valve outlet in the rest position of the valve body and, after the valve body leaves the rest position, the further annular groove leaves the return opening and at a same time spans a distance between the valve outlet and the constricted continuation of the annular groove.

In accordance with another feature of the invention, the return opening has a control edge that is concurrent with an outer edge of the second section of the valve chamber.

In accordance with a further feature of the invention, the control piston has a flow duct connecting the feed restrictor to the control space. The feed restrictor connects the valve inlet to the flow duct.

In accordance with another added feature of the invention, the discharger restrictor is a flow duct having an entry opening situated on a front of the chamber wall.

In accordance with another additional feature of the invention, the control piston has a stop element disposed on the rear active surface. The stop element, when the control piston reaches the working position, is placed in a sealing manner onto the entry opening of the discharge restrictor.

In accordance with another further feature of the invention, the first valve section is a control piston having a rear face with a bore formed therein. The control piston has an end wall defining an end of the bore. The chamber wall of the housing has a return connection and a discharge restrictor with an entry opening fluidically connected to the return connection. A further piston slides in a tight-fitting manner in the bore of the control piston. The further piston is supported on the chamber wall, and the further piston has a flow duct leading through the further piston to the entry opening of the discharge restrictor. The bore defines a control space formed between the end wall of the control piston and the further piston.

In accordance with an added feature of the invention, the housing has a pressure-equalizing duct leading from a space formed between the rear face of the control piston and the chamber wall to ambient pressure.

In accordance with an additional feature of the invention, the further piston has a front end reaching into the bore and strikes against a back of the bore, sealing off the flow duct leading to the discharge restrictor, when the control piston is in the working position.

In accordance with a further feature of the invention, the actuating device is an electromechanical actuator.

In accordance with another feature of the invention, a ball valve is disposed adjacent the discharge restrictor and the actuating device acts on the ball valve for blocking the discharge restrictor.

In accordance with a yet further feature of the invention, the valve outlet is to be connected to a primary side of a pressure intensifier in order to control a nozzle needle of the fuel injector.

In accordance with a concomitant feature of the invention, the actuating device is a piezo actuator.

Other features which are considered as characteristic for the invention are set forth in the appended claims.

Although the invention is illustrated and described herein as embodied in a control valve configuration for use in a fuel injector for internal combustion engines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
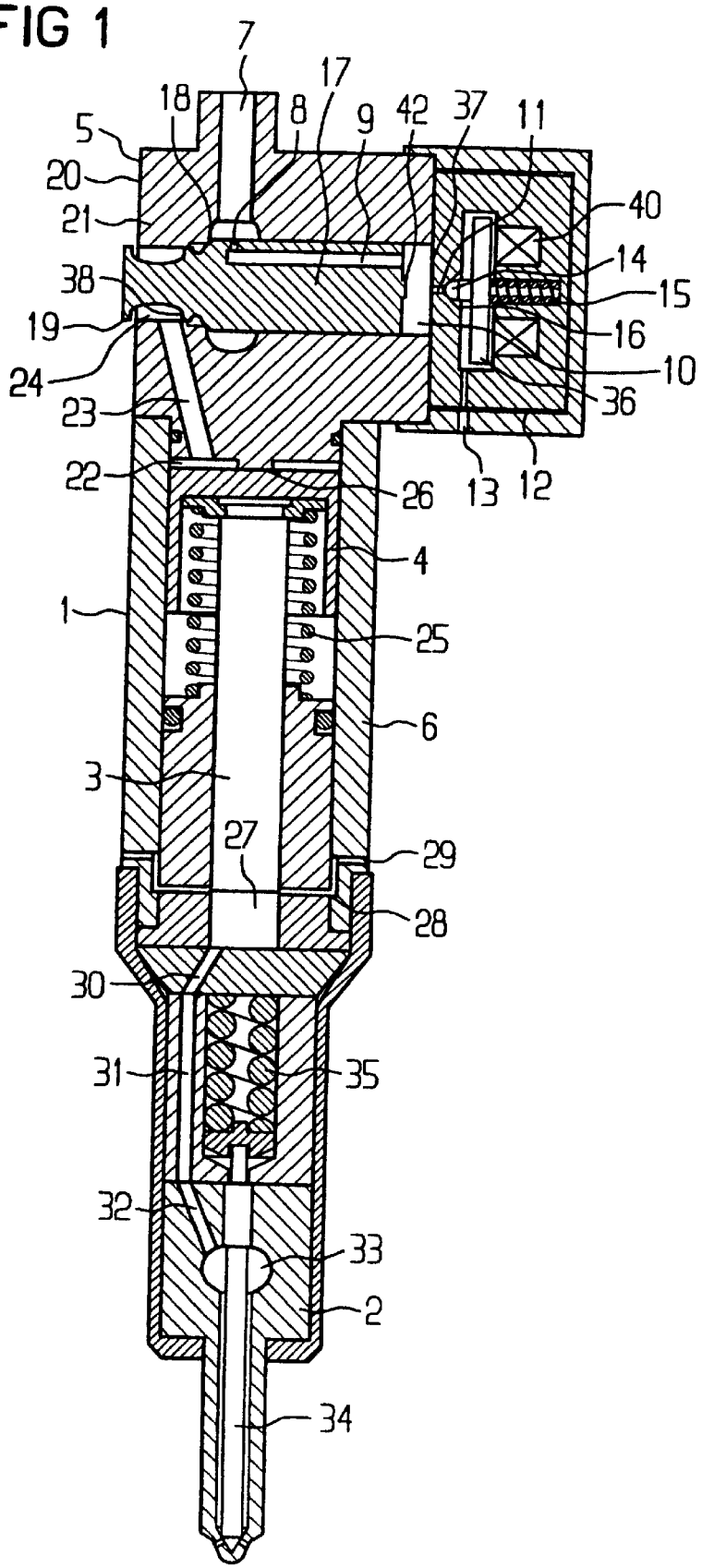
FIG. 1 is a diagrammatic, sectional view of a fuel injector with a first embodiment of a control valve configuration according to the invention.

Referring now to the figures of the drawing in detail and first, particularly, to FIG. 1 thereof, there is shown a fuel injector 1 having a hydraulic drive. The fuel injector 1 contains the customary components of an injector nozzle 2, a high-pressure piston 3, a pressure-intensifying piston 4 and a control valve configuration 5, which, together with an injector housing 6, form a construction unit. The injector 1 is illustrated in its rest state.

Figure 2:
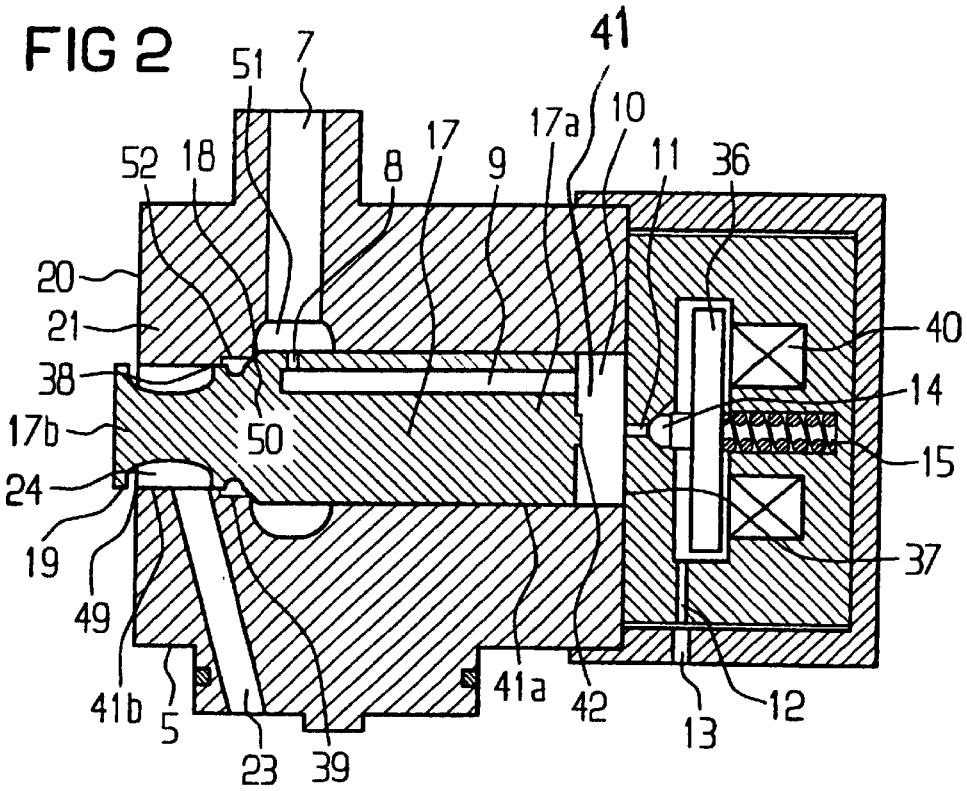
FIGS. 2, 3 and 4 are sectional views showing the control valve configuration according to FIG. 1 in three consecutive operating phases.
Figure 3:
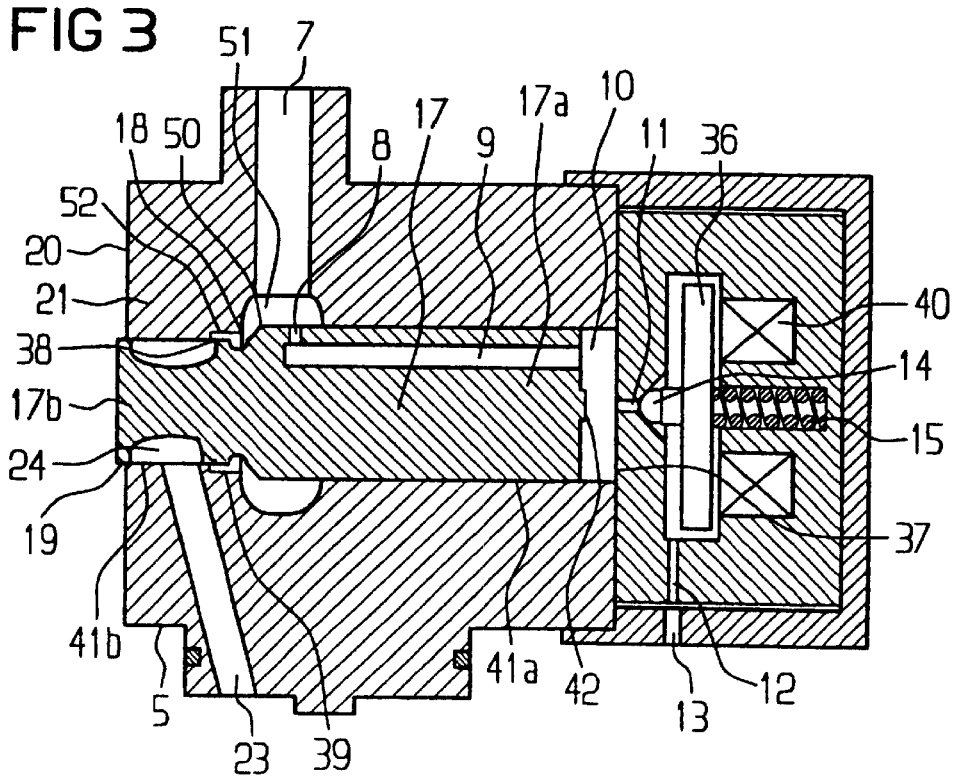
Figure 4:
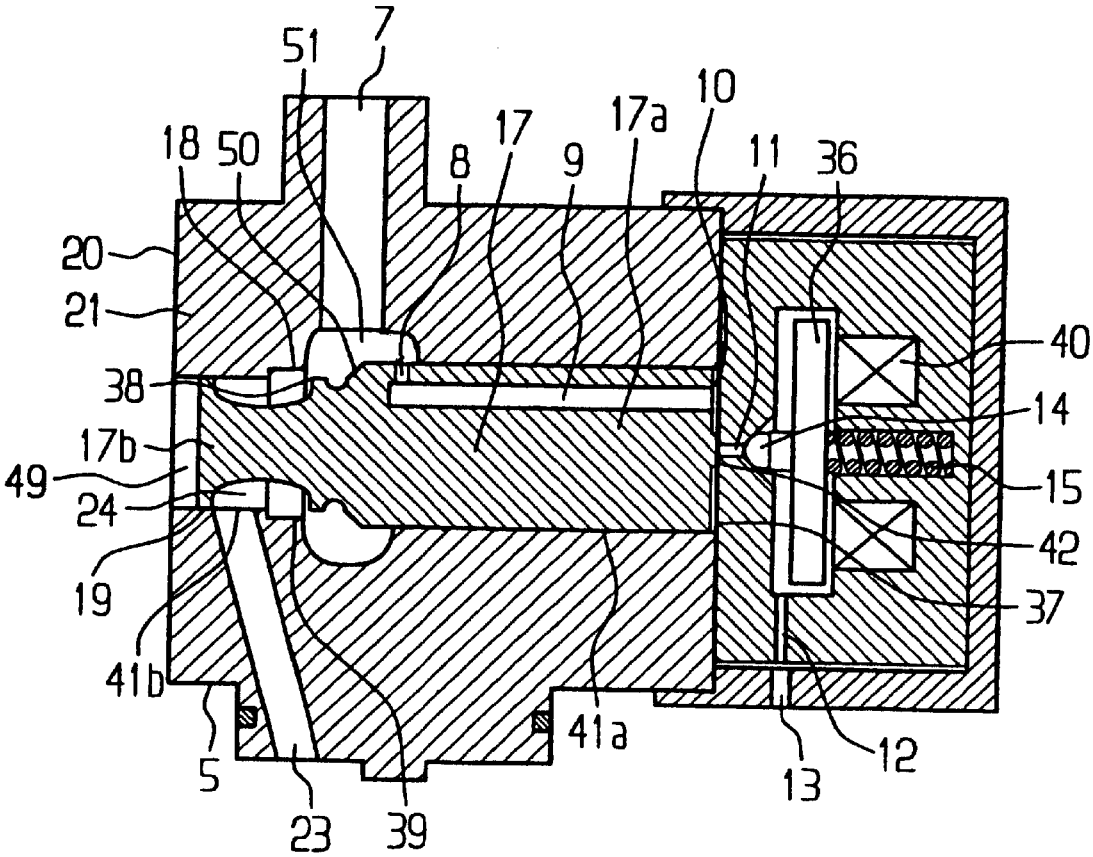

The details of the control valve configuration 5, which is contained in the injector 1 according to FIG. 1, in accordance with a first embodiment of the invention are revealed more clearly in the enlarged sectional illustrations shown in FIGS. 2, 3 and 4. The control valve configuration 5 has a valve housing 21 in which a valve chamber 41 is formed, the valve chamber 41 preferably having a circular cross-sectional form and having, aligned in an axial direction, two sections 41*a* and 41*b* of different diameters. In a region between the two sections 41*a* and 41*b* the chamber diameter is additionally widened by an annular groove 51 into which a valve inlet 7 opens. A valve outlet 23 opens on a wall of the second chamber section 41*b*.

Situated in an axially displaceable manner in the valve chamber 41 is a valve body 17 that is formed from two rigidly connected sections 17*a* and 17*b*. The first valve body section 17*a* extends into the first section 41*a* of the valve chamber 41 and the second valve body section 17*b* extends into the second section 41*b* of the valve chamber 41. The first valve body section 17*a* has a larger diameter and forms a control piston that slides in a tight-fitting manner in the first chamber section 41*a*. The second valve body section 17*b* is a slide that, together with a wall defining the second chamber section 41*b* of smaller diameter, forms a slide valve and is provided for this purpose with an annular groove 24. During movement of the valve body 17 a first control edge 38 of the annular groove 24 can run over an associated control edge 39 on a constricted continuation 52 of the inlet annular groove 51 in order alternatively to block or to open a fluidic connection from the inlet 7 to the outlet 23. Another control edge 19 of the annular groove 24 can run past an edge of the outer wall of the valve housing 21 on an end opening 49 of the valve chamber section 41*b*, in order to alternatively open or close a fluidic connection between the outlet 23 and a fluid return, into which the end opening 49 opens.

A preferably tapering circumferential surface 50 of the valve body 17 at a transition between the control piston 17*a* and the slide 17*b* constitutes a front side of the control piston 17*a* and forms in its central region a zone for resting on a conical valve seat 18, which is situated on that edge of the inlet annular groove 51 which has the tapering configuration.

A control space 10 is situated between a rear side of the control piston 17*a* and an end wall 37 of the valve chamber 41, the control space 10 is connected to the inlet annular groove 51 via a duct 9 in the control piston 17*a* and a feed restrictor 8. From the control space 10 a discharge restrictor 11 leads via a connecting duct 12 to a return connection 13. In a rest state, the discharge restrictor 11 is closed by a ball 14 that is pressed onto its seat 16 by a spring 15. By energizing a magnetizing coil 40, the spring 15 can be pulled back by an armature plate 36 in order to remove closing pressure.

During use of the injector 1, the inlet 7 of the control valve configuration 5 is connected to a non-illustrated pressure accumulator, a "rail", in which a working medium or control fluid, for example engine oil or fuel, is under high pressure. The return connection 13 and the end opening 49 on the outer wall 20 of the valve housing 21 communicate with a non-illustrated tank from which the control fluid is pumped back into the rail. The outlet 23 is connected to a space 22 on a primary side of the pressure-intensifying piston 4. The further details of the injector 1 illustrated in FIG. 1 and its manner of operation will be described below together with the operation of the control valve configuration 5.

In the rest state, i.e. in an injection interval, the solenoid valve or magnetizing coil 40 is deenergized. On account of the closed discharge restrictor 11 the rail pressure builds up in the control space 10 via the inlet 7, the feed restrictor 8 and the duct 9, the rail pressure pushing the control piston 17*a* of the valve body 17 to the left onto the conical seat 18 and therefore keeping the seat valve formed from the conical seat 18 and the conical surface 50 closed. In the position of the valve body 17 which is therefore assumed and is illustrated in FIG. 2, the control edge 19 of the slide 17*b* is situated past the outer wall 20 of the valve housing 21 and therefore frees up a connection from the primary space 22 of the pressure-intensifying piston 4 via the valve outlet 23 and the annular groove 22 to the return. The space 22 is therefore unpressurized. The pressure-intensifying piston 4 is pressed together with the high-pressure piston 3 against an upper stop 26 by a spring 25 (FIG. 1). A secondary space 27 on the high-pressure piston 3 is connected via inlet ducts 28 and 29 to a non-illustrated fuel supply system and is therefore filled with fuel. From the space 27 ducts 30, 31 and 32 lead into an annular space 33 of the injection nozzle 2. Supply pressure therefore prevails in the annular space 33, the pressure not being sufficient in order to open a nozzle needle 34 counter to the force of a nozzle spring 35.

From the rest state shown in FIG. 2, an injection process is initiated by supplying current to the magnetizing coil 40. The spring 15 which had closed the discharge restrictor 11 via the ball 14 is pulled back by the armature plate 36. The pressure in the control space 10 drops to an amount that is determined by a ratio of the flow resistances of the feed and the discharge restrictors. On the front side of the control piston 17*a* the full rail pressure acts on an annular surface that is formed by the conical surface 50 in the region radially outside the valve seat 18. The annular surface is dimensioned in comparison with the active surface on the rear side of the control piston 17*a* in such a manner that the force exerted by the rail pressure on the control piston 17*a* predominates and moves the latter to the right until a stop surface 42 on a rear side of the piston 17*a* reaches the end wall 37 and at the same time obstructs the discharge restrictor 11. The control piston 17 oscillates in this position, the stop surface 42 periodically opening and closing the discharge restrictor 11. This state is the operating state shown in FIG. 4.

FIG. 3 shows a first movement phase after the solenoid valve 40 has been fed with current and shortly after the valve body 17 has left the rest position shown in FIG. 2. By its movement to the right the control piston 17*a* has opened up the valve seat 18. The control edge 19 on the annular groove 24 of the slide 17*b* has just reached the corresponding. control edge to the outer wall 20 of the housing and has therefore interrupted the connection between the outlet 23 and the outside world (return system). The other control edge 38 on the annular groove 24 is still overlapping the control edge 39 of the valve housing 21 and thus still obstructs the connection between the rail pressure and the outlet 23. On the other hand, the rail pressure is now also located on the radially inner continuation of the conical surface 50 of the control piston 17*a*. As a consequence of the thus enlarged active surface, the movement of the control piston 17*a* to the right is accelerated and the closing force of the stop 42 on the discharge restrictor 11 is intensified.

On reaching the end position shown in FIG. 4, i.e. in the working position, the seat valve 50, 18 is opened wide, and the control edge 38 of the slide 17*b* is moved completely away from the corresponding control edge 39, with the result that a direct connection from the rail via the annular groove 24 to the outlet 23 and from there to the primary space 22 of the pressure-intensifying piston 4 is opened up. In consequence, the pressure-intensifying piston 4 and the high-pressure piston 3 move downward, the high-pressure piston 3 closing the feed bore 28. Subsequently, high pressure builds up in the secondary space 27 below the high-pressure piston 3, the pressure being substantially higher than the rail pressure, since the active surface of the pressure-intensifying piston 4 is substantially larger than the cross-sectional surface of the high-pressure piston 3. The high pressure passes via the ducts 30, 31 and 32 into the annular space 33 of the injection nozzle 2, which automatically opens in a customary manner and injects the fuel.

The end of the injection is initiated by interrupting the supply of current to the solenoid valve 40. The discharge restrictor 11 is closed again by the ball 14, the pressure in the control space 10 again reaches the level of the rail pressure, and the valve body 17 moves back again into the rest position shown in FIG. 2. The seat valve 18, 50 closes, and the connection between the outlet 23 and the return opening 49 on the outer wall 20 of the housing is re-opened, with the result that the primary space 22 above the pressure-intensifying piston 4 is unpressurized. The spring 25 moves the pressure-intensifying piston 4 and the high-pressure piston 3 into the starting position, the space 22 back via the valve outlet 23 and the annular groove 24 to the return emptying, and the secondary space 27 again filling with fuel via the ducts 28 and 29. The injection nozzle 2 closes automatically by the force of the nozzle spring 35.

Figure 5:
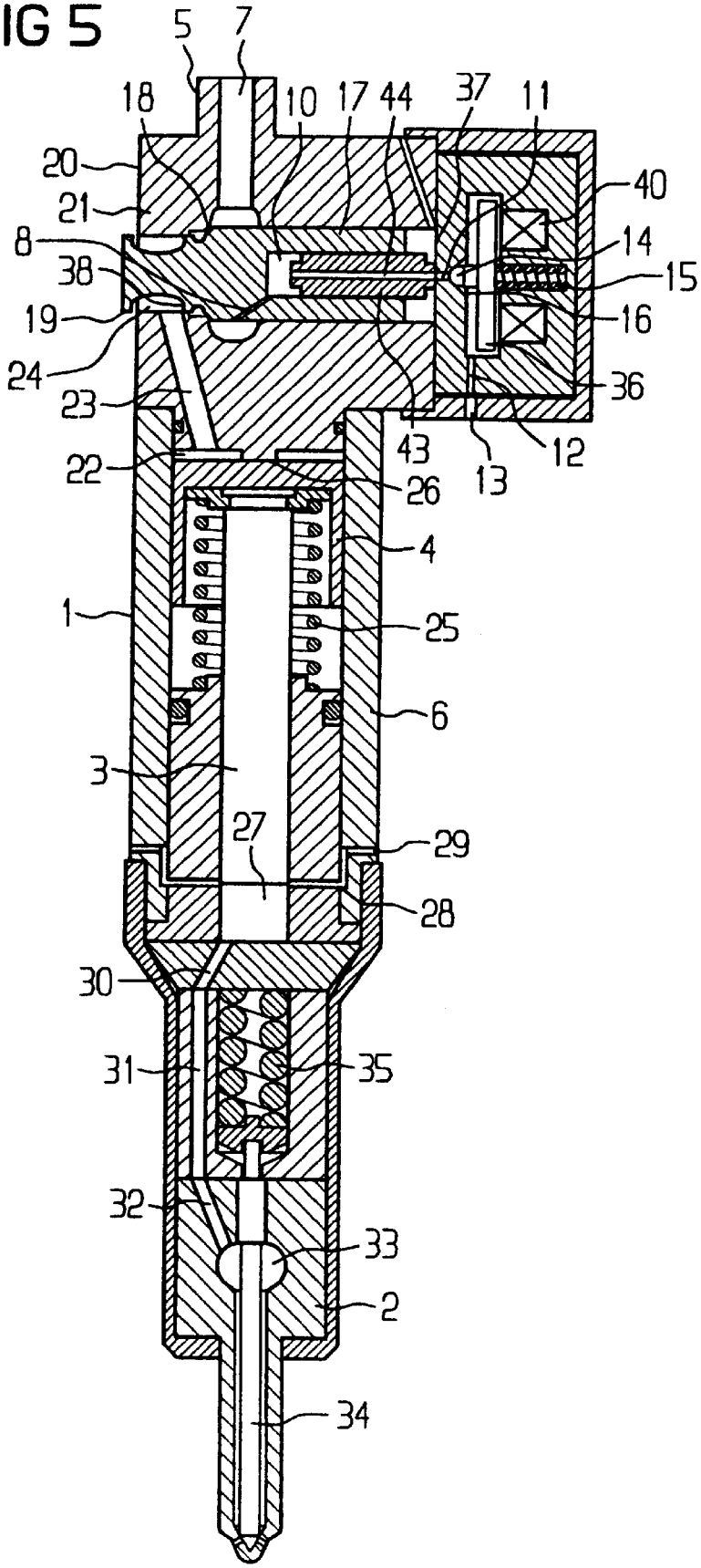
FIG. 5 is a sectional view of the fuel injector with a second embodiment of the control valve configuration according to the invention.

The injector illustrated in FIG. 5 is, with the exception of the some small differences in the control valve configuration, of identical construction to the injector according to FIG. 1. Identical parts and parts having the same function are denoted in FIG. 5 and in FIGS. 6, 7, 8 with the same reference numbers as in FIGS. 1 to 4. In order to avoid repetitions, only those features will be described below in which the second embodiment, which is shown in FIGS. 5 to 8, differs from the first embodiment according to FIGS. 1 to 4.

The only differences are the configuration of the valve body section 17*a*, which forms the control piston 17*a*, and the configuration and occupation of the space on the rear side thereof. In the case of the second embodiment, there leads into the rear side of the control piston 17*a* a blind bore 48 in which a second piston 43, which is penetrated by a duct 44 in the axial direction, is situated such that it slides in a tight-fitting manner. The rear side of the second piston 43 is supported on the end wall 37 of the valve chamber section 41*a*, specifically in such a manner that the duct 44 is connected to an entry opening of the discharge restrictor 11. From a front part of the control piston 17*a* in the region of the inlet annular groove 51 the feed restrictor 8 leads into a space at a foot of the bore 48. The annular space 47 surrounding the second piston 43 between the rear end of the control piston 17*a* and the end wall 37 of the valve chamber section 41*a* has a pressure-equalizing connection 45 to the outside.

In this embodiment, the control space 10 is formed by the space at the foot of the bore 48 between a back 46 of the bore 48 and a facing end of the second piston 43. In the rest position according to FIG. 6, the rail pressure builds up in the control space 10, because of the closed discharge restrictor 11, via the inlet 7, the inlet annular groove 51 and the feed restrictor 8, which pushes the control piston 17*a* to the left, by acting upon its rear active surface at the back 46 of the bore 48, and keeps the seat valve 18, 50 closed. After opening of the discharge restrictor 11 by energizing the magnetizing coil 40, the fluid flows out of the control space 10 through the duct 44 via the discharge restrictor 11 to the return connection 13, with the result that the pressure in the control space 10 decreases and the control piston 17*a* moves to the right, according to FIG. 7, until the back 46 of the bore 48 strikes against the front end of the second piston 43 and closes the duct 44, so that no further fluid is able to flow to the discharge restrictor 11. The control piston 17 oscillates in this position and periodically opens and closes the duct 44. This is the working state shown in FIG. 8.

Figure 6:
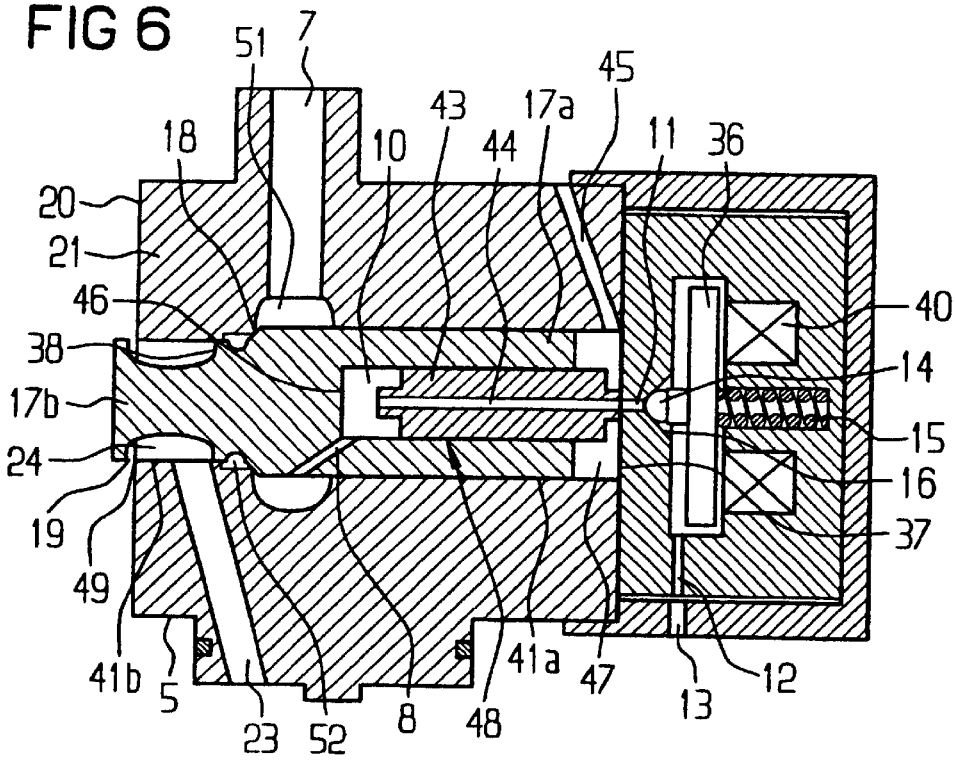
FIGS. 6, 7 and 8 are sectional view showing the control valve configuration according to FIG. 5 in three consecutive operating phases.
Figure 7:
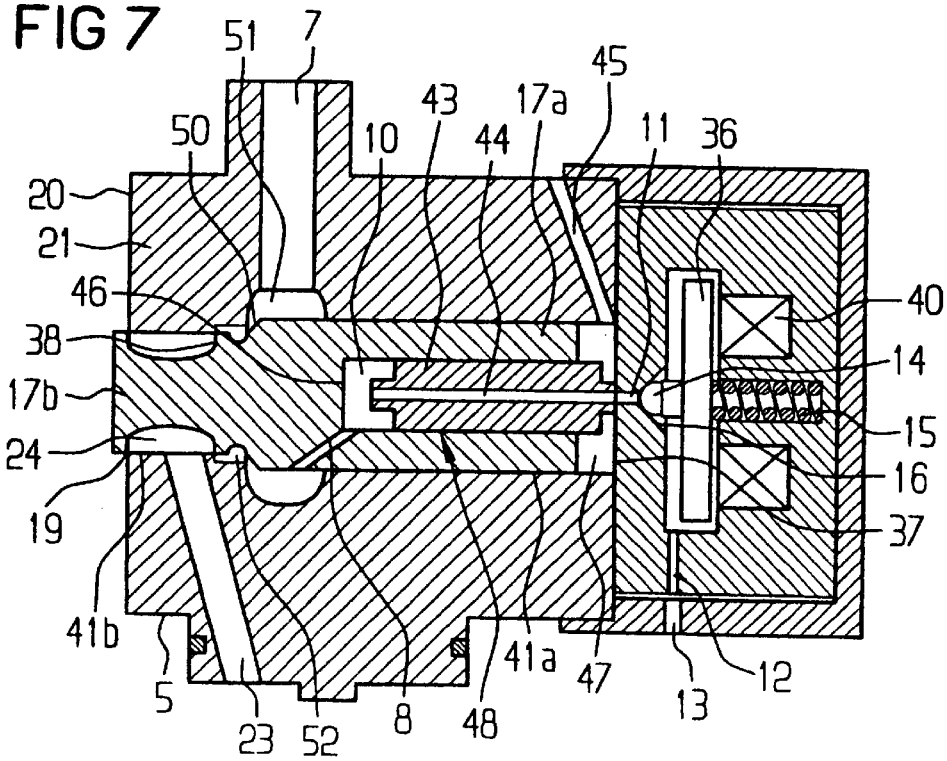
Figure 8:
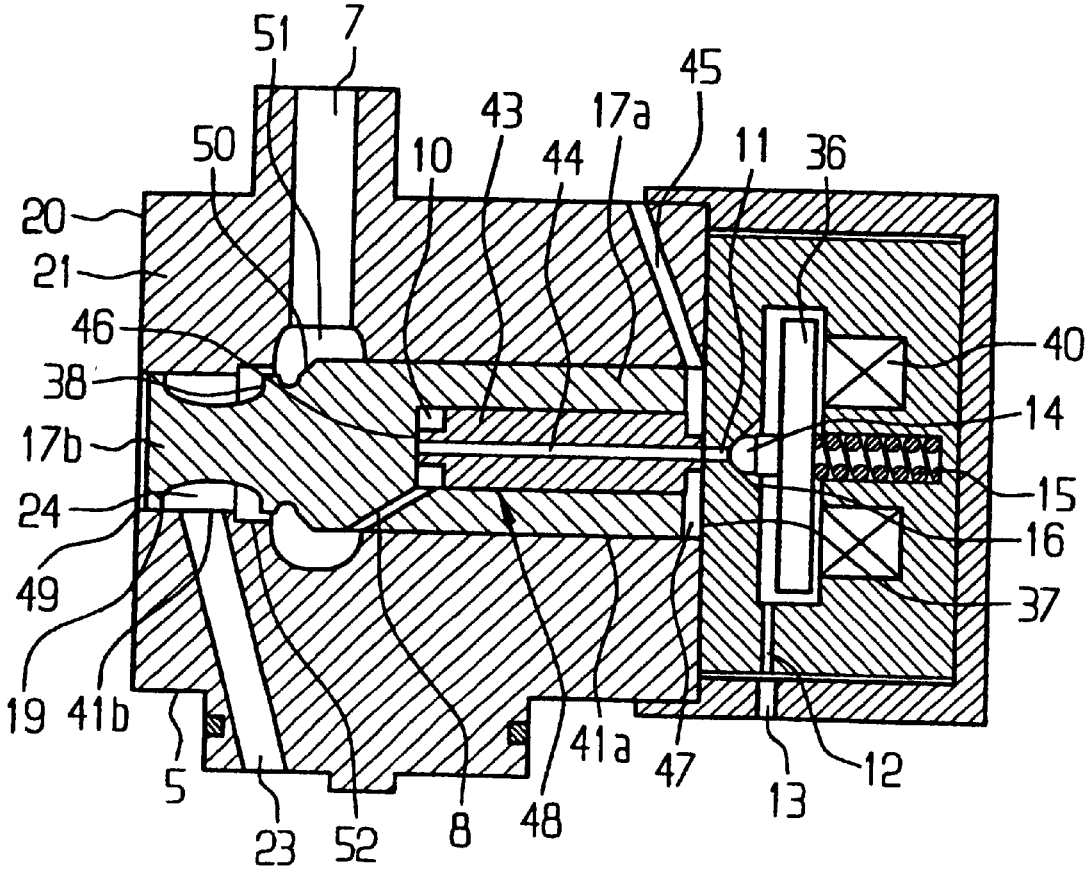

The other parts of the valve body 17, which, together with the corresponding regions of the valve chamber 41, form the seat valve and the slide valve, act in the rest position according to FIG. 6, in the intermediate position according to FIG. 7 and in the working position according to FIG. 8 precisely in the manner as has been described above with reference to FIGS. 2, 3 and 4 for the first embodiment.

Of course, other refinements of the invention are possible in addition to the exemplary embodiments described. Thus, the control piston 43, instead of being situated in the bore of the valve body 17*a*, can also be situated in the correspondingly large bore of a stop surface 37, in which case the ducts to the feed restrictor have to be guided through the valve housing. Instead of a hydraulic control of the valve body via a control space a direct actuation of the valve body can also be ensured, for example by a physical connection to the armature of a magnetizing coil or to another electromechanical transducer. Also, the use of the control valve configuration according to the invention is not restricted to the actuation of a pressure intensifier; the outlet 23 can also be connected directly. to the inlet duct of an injector nozzle if the rail pressure is dimensioned to be sufficiently high. In this case, the fluid that flows through the control valve configuration is, of course, fuel, for example diesel oil.

I claim:

1. A control valve configuration for use in a fuel injector for an internal combustion engine, the control valve configuration comprising:

a housing having a valve chamber formed therein, a valve inlet formed therein for a fluid which is under pressure, and a valve outlet formed therein for hydraulically controlling an injection process at a nozzle of the fuel injector, said valve chamber having a first section, a second section, and a return opening, said housing further having a chamber wall defining a rear of said valve chamber and a seat defining a first part of a seat valve disposed in said first section;

an actuating device disposed in said housing; and a valve body disposed in said valve chamber, said valve body can be displaced axially by said actuating device and, depending on a position of said valve body, said valve body produces or blocks a fluidic connection between said valve inlet and said valve outlet, said valve body having a first valve section forming a second part of said seat valve disposed between said valve inlet and said valve outlet in said first section of said valve chamber, said seat valve being closed in a rest position of said valve body and being opened in a working position of said valve body, said valve body having a second valve section rigidly connected to said first valve section, said second section of said valve chamber and said second valve section forming a slide valve which, in the rest position of said valve body produces a fluidic connection between said valve outlet and said return opening and blocks a fluidic connection between said seat valve and said valve outlet, said slide valve closes said return opening and then starts to produce a fluidic connection between said seat valve and said valve outlet only after said valve body leaves the rest position, said first section of said valve chamber passing via said seat of said seat valve in a direction of flow into said second section of said valve chamber.

2. The control valve configuration according to claim 1, wherein:

said first valve section is a control piston sliding in a tight-fitting manner in said first section of said valve chamber, said control piston having a front side facing said seat of said seat valve, said front side having an annular active surface which is exposed to a valve inlet pressure, said control piston further having a rear active surface; said first valve section has a feed restrictor formed therein;

said chamber wall of said housing having a return connection formed therein and a discharge restrictor formed therein and fluidically connected to said return connection; and said valve chamber defining a control space being a space behind said rear active surface of said control piston, said control space connected to said valve inlet through said feed restrictor and to said return connection through said discharge restrictor which is to be opened by said actuating device, flow resistances of said feed restrictor and said discharge restrictor and a proportion in size between said annular active surface and said rear active surface being dimensioned in such a manner that said valve body moves into the working position when said discharge restrictor is opened and moves into the rest position when said discharge restrictor is closed.

3. The control valve configuration according to claim 2, wherein said control piston is configured such that when said control piston reaches the working position, said control piston presses in a sealing manner onto an access between said control space and said discharge restrictor.

4. The control valve configuration according to claim 2, wherein said first section of said valve chamber which contains said control piston has a diameter larger than a diameter of said second section of said valve chamber which forms said slide valve, said seat of said seat valve is formed by a conically shaped housing edge of said housing which is situated at a transition region between said first and second sections of said valve chamber, said front side of said control piston having an annular surface with a central zone which rests in a sealing manner on said seat when said valve body is in the rest position.

5. The control valve configuration according to claim 4, wherein said annular surface on said front side of said control piston is a tapering transition area on said valve body connecting said first valve section to said second valve section, said first valve section having a diameter greater than a diameter of said second valve section, said housing having an annular groove with a constricted continuation formed therein, said conically shaped housing edge forming said seat of said seat valve is an edge of said housing disposed between said annular groove and said constricted continuation in said valve chamber, said valve inlet leading into said annular groove and said annular groove having a diameter larger than said diameter of said first section of said valve chamber, and said constricted continuation of said annular groove forming a control edge for said slide valve at a transition region to said second section of said valve chamber.

6. The control valve configuration according to claim 5, wherein said second valve section has a further annular groove formed therein, said further annular groove having an axial dimension dimensioned in such a manner that it spans a distance between said return opening and said valve outlet in the rest position of said valve body and, after said valve body leaves the rest position, said further annular groove leaves said return opening and at a same time spans a distance between said valve outlet and said constricted continuation of said annular groove.

7. The control valve configuration according to claim 6, wherein said return opening has a control edge being concurrent with an outer edge of said second section of said valve chamber.

8. The control valve configuration according claim 2, wherein said control piston has a flow duct formed therein connecting said feed restrictor to said control space, said feed restrictor connecting said valve inlet to said flow duct.

9. The control valve configuration according to claim 8, wherein said discharger restrictor is a flow duct having an entry opening situated on a front of said chamber wall.

10. The control valve configuration according to claim 9, wherein said control piston has a stop element disposed on said rear active surface, said stop element, when said control piston reaches the working position, is placed in a sealing manner onto said entry opening of said discharge restrictor.

11. The control valve configuration according to claim 1, wherein said first valve section is a control piston having a rear face with a bore formed therein, said control piston having an end wall defining an end of said bore;

wherein said chamber wall of said housing having a return connection formed therein and a discharge restrictor with an entry opening formed therein and fluidically connected to said return connection;

including a further piston sliding in a tight-fitting manner in said bore of said control piston, said further piston supported on said chamber wall, said further piston having a flow duct formed therein leading through said further piston to said entry opening of said discharge restrictor; and said bore defining a control space formed between said end wall of said control piston and said further piston.

12. The control valve configuration according to claim 11, wherein said housing has a pressure-equalizing duct formed therein, said pressure-equalizing duct leading from a space formed between said rear face of said control piston and said chamber wall to ambient pressure.

13. The control valve configuration according to claim 11, wherein said further piston has a front end reaching into said bore and strikes against a back of said bore, sealing off said flow duct leading to said discharge restrictor, when said control piston is in the working position.

14. The control valve configuration according to claim 2, wherein said actuating device is an electromechanical actuator.

15. The control valve configuration according to claim 2, including a ball valve disposed adjacent said discharge restrictor and said actuating device acts on said ball valve for blocking said discharge restrictor.

16. The control valve configuration according to claim 1, wherein said valve outlet is to be connected to a primary side of a pressure intensifier in order to control a nozzle needle of the fuel injector.

17. The control valve configuration according to claim 2, wherein said actuating device is a piezo actuator.

* * * * *